US008276606B2

(12) United States Patent
Chen

(10) Patent No.: US 8,276,606 B2
(45) Date of Patent: Oct. 2, 2012

(54) SEMI-AUTOMATIC UMBRELLA WITH AN AUTOMATICALLY RETRACTABLE CENTRAL SHAFT

(76) Inventor: Hsia-Hui Chen, Jhubei (TW)

( * ) Notice: Subject to any disclaimer, the term of this patent is extended or adjusted under 35 U.S.C. 154(b) by 29 days.

(21) Appl. No.: 13/065,492

(22) Filed: Mar. 22, 2011

(65) Prior Publication Data

US 2012/0012140 A1 Jan. 19, 2012

(30) Foreign Application Priority Data

Jul. 15, 2010 (CN) ..... 2010 1 0226651

(51) Int. Cl.
*A45B 25/16* (2006.01)
*A45B 25/14* (2006.01)

(52) U.S. Cl. ..... 135/24; 135/22; 135/25.1

(58) Field of Classification Search ..... 135/22, 135/24, 25.1, 28, 37, 38, 41
See application file for complete search history.

(56) References Cited

U.S. PATENT DOCUMENTS 5,441,065 A * 8/1995 Lin et al. ..... 135/24
5,533,541 A * 7/1996 Cheng et al. ..... 135/22
5,617,889 A * 4/1997 Wu ..... 135/22
5,823,215 A * 10/1998 Chou et al. ..... 135/24
6,016,822 A * 1/2000 Lin et al. ..... 135/24
6,112,755 A * 9/2000 Lin et al. ..... 135/24
6,338,353 B1 * 1/2002 Chen ..... 135/20.3
6,360,759 B1 * 3/2002 Lin et al. ..... 135/24
6,484,452 B2 * 11/2002 Yen ..... 52/24
6,817,371 B2 * 11/2004 Lin et al. ..... 135/24
7,461,666 B2 * 12/2008 Huang ..... 135/22

* cited by examiner

*Primary Examiner* — Winnie Yip
(74) *Attorney, Agent, or Firm* — Knobbe Martens Olson & Bear LLP

(57) ABSTRACT

A semi-automatic umbrella includes a telescopic central shaft, a handle, and a runner slidable along the shaft. A first pull cord is placed in a tensed state when the shaft is extended, which causes an upward biased movement of an actuating member to thrust a spring-biased runner-retaining member to disengage from the shaft once the first pull cord is released. A tension spring body coupled to a second pull cord is stretchable to acquire an urging force. The stretched tension spring body enables an upward movement of the runner for spreading the umbrella. Once the urging force is released, a downward movement of the runner causes collapse of the umbrella and disengagement of a spring-biased shaft-retaining member from the shaft, thereby permitting folding of the shaft and closing the umbrella.

7 Claims, 16 Drawing Sheets

SEMI-AUTOMATIC UMBRELLA WITH AN AUTOMATICALLY RETRACTABLE CENTRAL SHAFT

CROSS-REFERENCE TO RELATED APPLICATION

This application claims priority of Chinese Patent Application No. 201010226651.4, filed on Jul. 15, 2010, the disclosure of which is herein incorporated by reference.

BACKGROUND OF THE INVENTION

1. Field of the Invention

This invention relates to a semi-automatic umbrella, more particularly to a semi-automatic umbrella with an automatically retractable central shaft.

2. Description of the Related Art

Referring to FIG. 1, an auto-collapsible umbrella as disclosed in Taiwanese Utility Model No. M571657 includes a handle 1, a central shaft 2 mounted on the handle 1, an upper hub 3 secured on an upper end of the central shaft 2, a runner 4 disposed between the upper hub 3 and the handle 1, a rib-and-stretcher assembly 5 connecting the upper hub 3 and the runner 4, and a closing control unit 6. The handle 1 has a push button 101. The central shaft 2 includes a plurality of tubes 201 telescopically fitted to each other and a plurality of spring-loaded rings 202 disposed to retain two adjacent tubes 201 when the central shaft 2 is extended. The runner 4 has a latch 301 disposed to position the runner 4 on the central shaft 2. The closing control unit 6 includes a main spring 601 disposed between the upper hub 3 and the handle 1, a retained block 602 disposed in the handle 1 and connected to the main spring 601, a first spring 603 interconnecting the retained block 602 and a bottom wall of the handle 1, a cord 604 having one end connected to the retained block 602, an actuating member 605 connected to the other end of the cord 604, and a second spring 608 disposed to bias the actuating member 605 downwardly. The actuating member 605 has a large-diameter portion 606 and a small-diameter portion 607.

In use, the runner 4 is moved toward the upper hub 3 by a manual force to extend the central shaft 2 and to permit the central shaft 2 to be held in an extended position by means of the spring-loaded rings 202. The retained block 602 is retained by a retaining portion of the push button 101. The small-diameter portion 607 of the actuating member 605 is engaged with the latch 301 to lock the runner 4 to the central shaft 2.

When it is desired to close the umbrella, the push button 101 is pushed to permit disengagement of the retained block 602 from the retaining portion. By means of the second spring 608, the actuating member 605 is moved downwardly to permit the large-diameter portion 606 to move the latch 301 out of the central shaft 2. Hence, the rib-and-stretcher assembly 5 can be collapsed. By means of the main spring 601, the runner 4 is moved toward the handle 1 to sequentially retract the spring-loaded rings 202 so as to fold the central shaft 2.

However, when opening the umbrella, due to the presence of the main spring 601, a relatively large manual force is required to move the runner 4 until the runner 4 reaches a position where the rib-and-stretcher assembly 5 is totally spread out.

SUMMARY OF THE INVENTION

An object of the present invention is to provide a semi-automatic umbrella which can be opened effortlessly, and which can be closed and folded automatically.

According to this invention, the semi-automatic umbrella includes a central shaft having at least an upper tube and a middle tube telescopically fitted to each other, a direction reversing member disposed in an upper end of the central shaft, a spring-biased shaft-retaining member disposed on the middle tube and engageable with the upper tube so as to hold the upper tube in an extended position, a runner disposed around the central shaft and slidable therealong between upper and lower positions to spread and collapse the umbrella, respectively, a spring-biased runner-retaining member disposed in the runner and biased to be engaged with the upper tube, a closing biasing member disposed to bias the upper tube to a retracted position, and a handle secured to the lower end of the central shaft, and having first and second anchored portions.

The semi-automatic umbrella further includes a tension retaining member and first and second pull units.

The tension-retaining member has a first anchoring portion disposed to anchor the first anchored portion, and is operable manually to disengage the first anchoring portion from the first anchored portion to permit axial movement thereof.

The first pull unit includes an actuating member mounted in the upper tube, a first pull cord connected to the actuating member and the tension retaining member such that, when the upper tube is displaced from the retracted position to the extended position, the actuating member is displaced to a proximate position, where the first pull cord is in a tensed state, and a first auxiliary biasing member disposed between the actuating member and the middle tube with such a first bias force that, once the tension retaining member is released, an upward biased movement of the actuating member to a distal position thrusts the spring-biased runner-retaining member to be disengaged from the upper tube so as to permit movement of the runner toward the upper position.

The second pull unit includes a retained member mounted to releasably anchor the second anchored portion, a tension spring body coupled to the retained member and stretched when the upper tube is moved to the extended position to have an urging force, a second pull cord connected to the runner and the tension spring body through the direction reversing member such that the urging force urges the runner to move from the lower position to the upper position when the tension retaining member is released, a trigger member coupled to the second pull cord, moved with the runner so as to counteract the urging force, and movable to a ready position where the trigger member is disposed axially and upwardly from the spring-biased shaft-retaining member, and a second auxiliary biasing member disposed to have a second bias force such that, when the retained member is released from the second anchored portion, the trigger member is biased by the second bias force to dash downward and away from the ready position so as to thrust the spring-biased shaft-retaining member to disengage from the upper tube, thereby permitting a displacement of the upper tube from the extended position to the retracted position by the closing biasing member.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
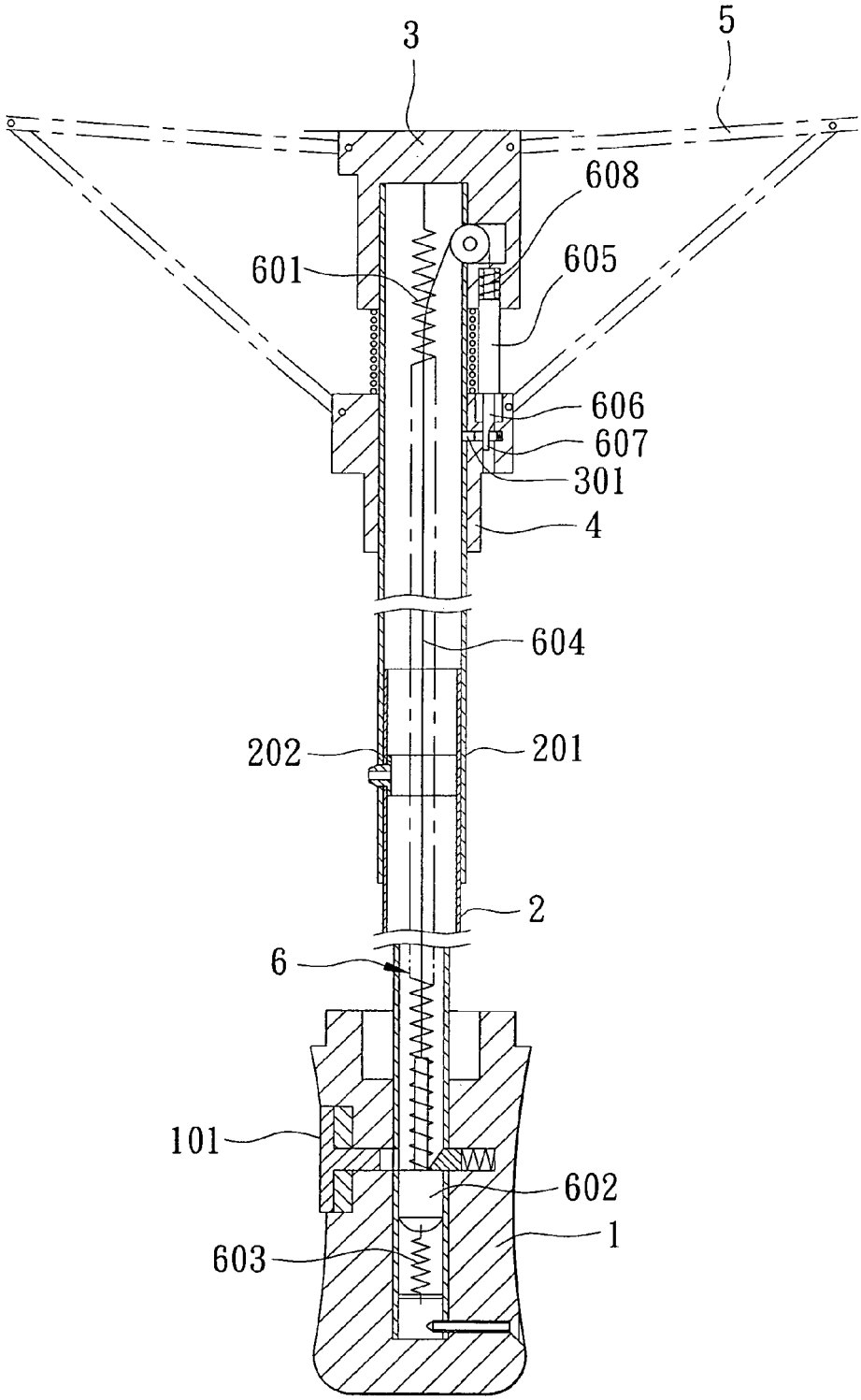
FIG. 1 PRIOR ART
FIG. 1 is a sectional view of a conventional auto-collapsible umbrella.
Figure 2:
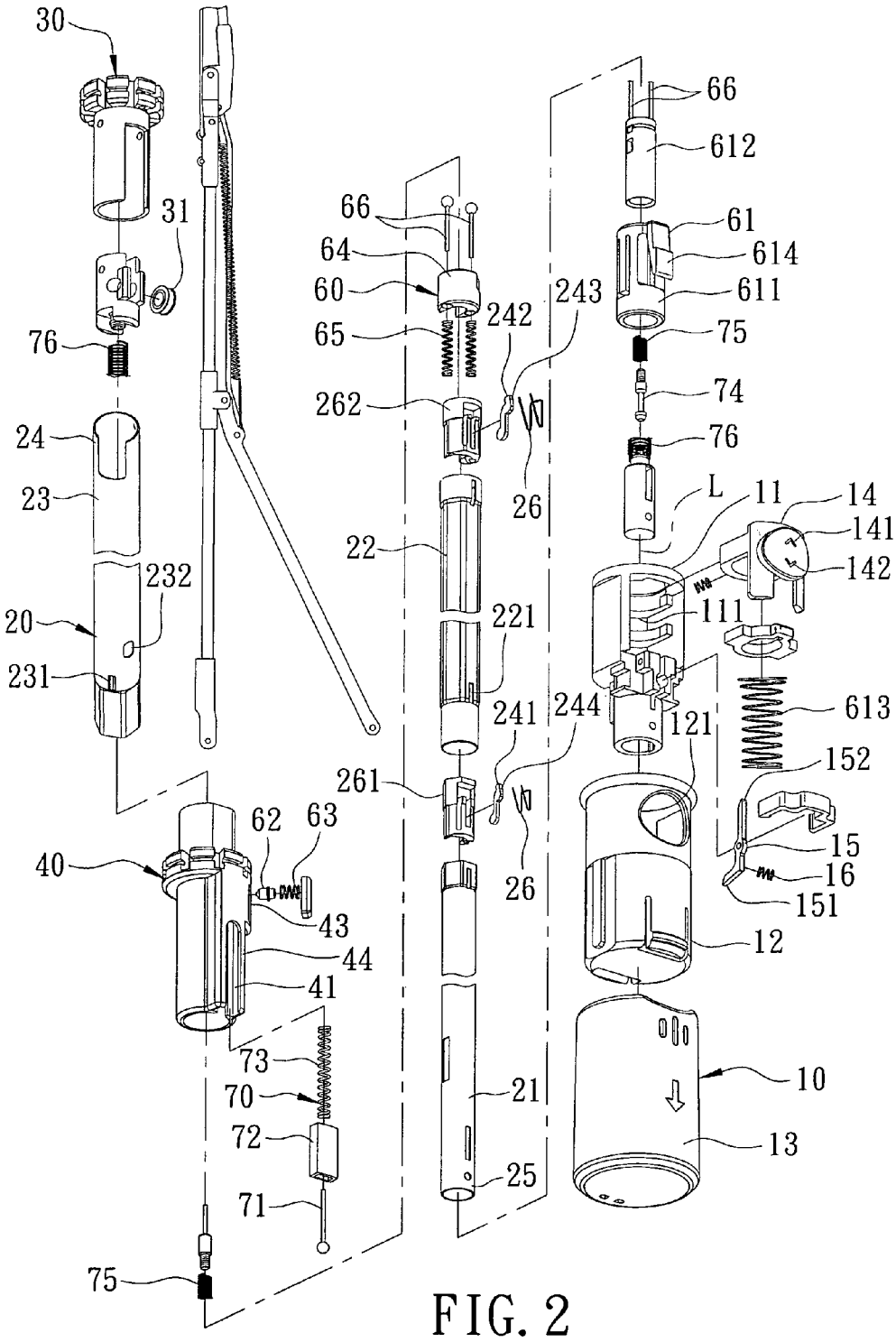
FIG. 2 is an exploded perspective view of the preferred embodiment of a semi-automatic umbrella according to this invention.
Figure 5:
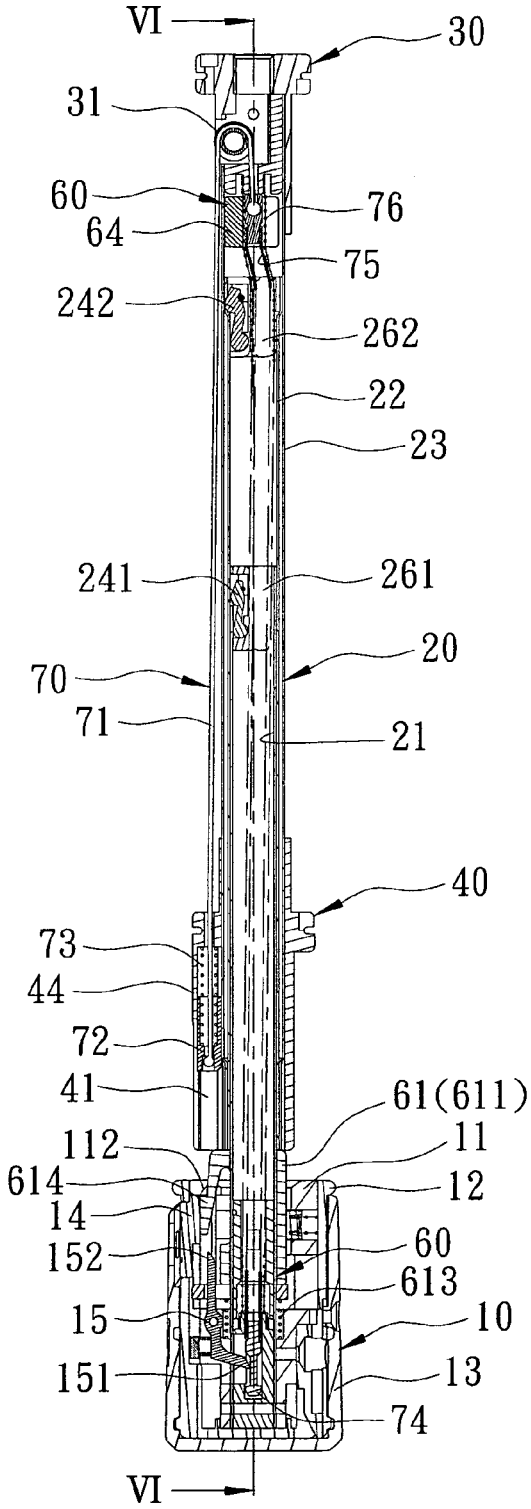
FIG. 5 is a sectional view of the preferred embodiment.
Figure 6:
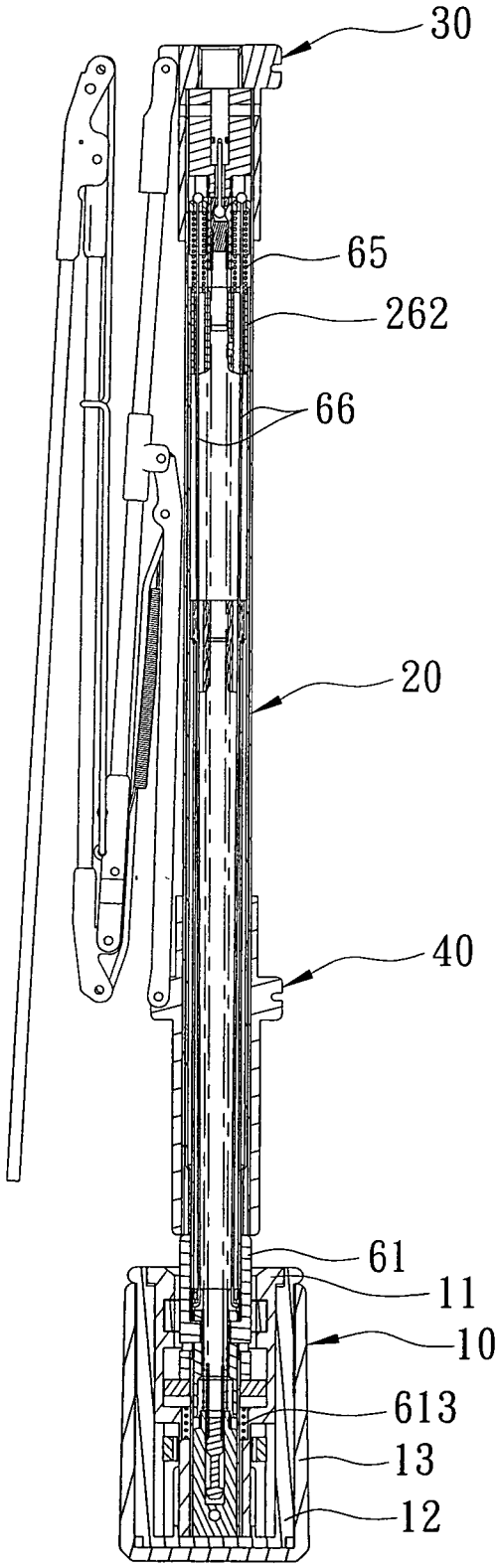
FIG. 6 is a sectional view taken along line VI-VI of FIG. 5.

Referring to FIGS. 2, 5 and 6, the preferred embodiment of a semi-automatic umbrella according to the present invention is shown to comprise a central shaft 20 having upper and lower ends 24,25 opposite to each other along an axis (L), an upper hub 30 secured to the upper end 24 of the central shaft 20, a runner 40 which is disposed around the central shaft 20 and which is slidable therealong between upper and lower positions to spread and collapse the umbrella, respectively, a handle 10 secured to the lower end 25 of the central shaft 20, a closing biasing member 76, a tension retaining member 61, a first pull unit 60, and a second pull unit 70.

The central shaft 20 includes an upper tube 23, a middle tube 22, and a lower tube 21 telescopically fitted to one another along the axis (L). Each of the upper and middle tubes 23,22 has a bottom segment which has a hooked slit 231,221. Each of the middle and lower tubes 22,21 has a top segment and a seat mount 262,261 disposed in the top segment. Each of two spring-biased shaft-retaining member 242,241 is mounted on the respective seat mount 262,261, and has a shaft-retaining end 243,244 which is biased radially and outwardly of a respective one of the middle and lower tubes 22,21 by a spring 26 to be snapped into the respective hooked slit 231,221 when the upper and middle tubes 23,22 are displaced to an extended position where the upper and middle tubes 23,22 are remote from the lower end 25. The bottom segment of the upper tube 23 further has a through hole 232 extending radially.

A direction-reversing member 31 is in the form of a pulley, and is disposed on the upper hub 30.

Figure 10:
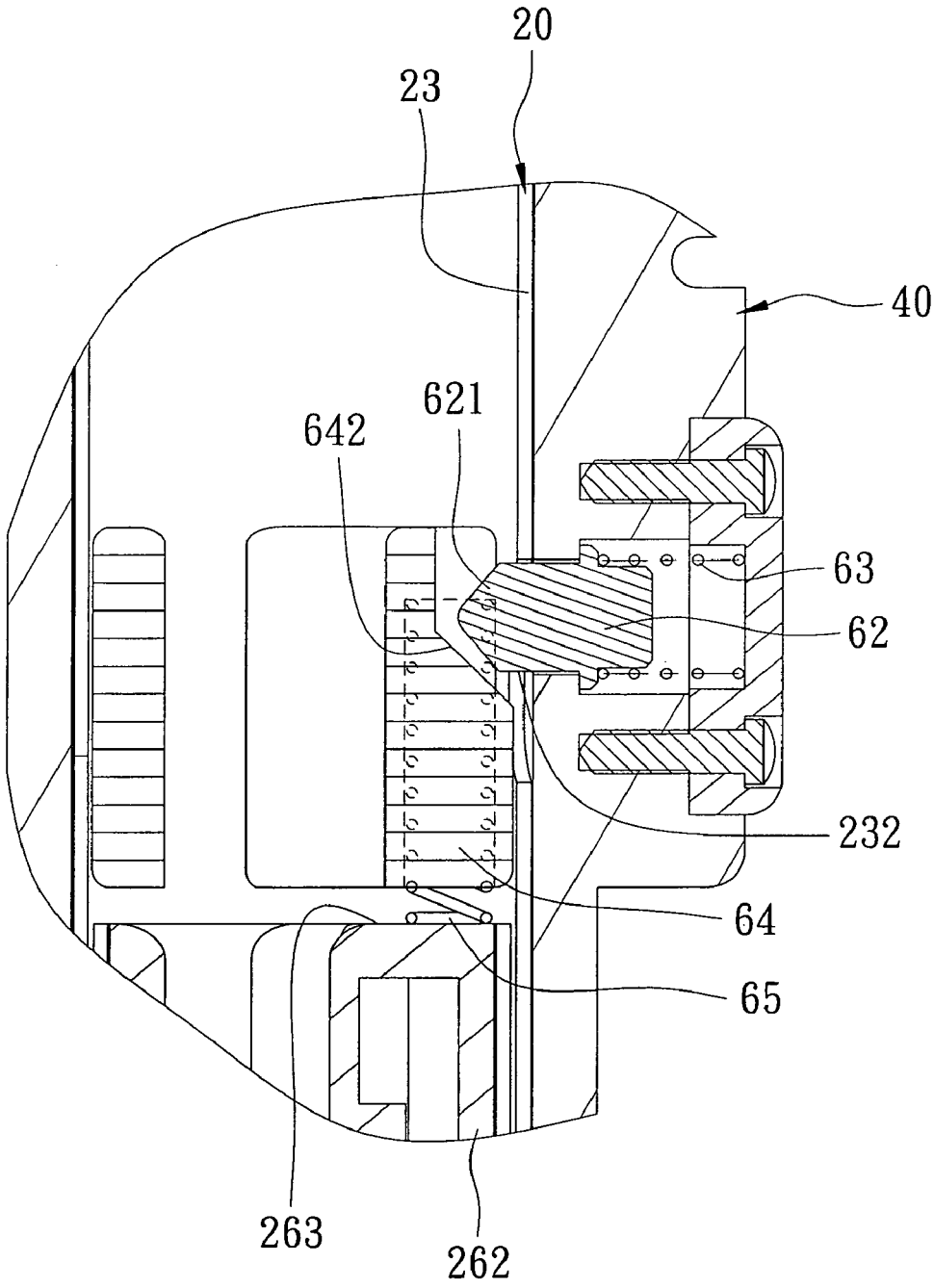
FIG. 10 is a sectional view taken along line X-X of FIG. 9.

The runner 40 has a through slot 43 extending radially. A spring-biased runner-retaining member 62 is disposed in the through slot 43 and is biased by a spring 63 to permit a retaining end 621 thereof to extend into the upper tube 23 through the through hole 232 (as shown in FIG. 10). The runner 40 has a guide track member 44 which defines a guide route 41 extending axially.

The handle 10 includes an inner tubular body 11 defining a receiving space 111 and formed with a first anchored portion 112 in the receiving space 111 (as shown in FIG. 5), an outer tubular body 12 surrounding the inner tubular body 11 and having a button opening 121, a push button 14 disposed in the button opening 121 and having two button portions 141,142 to be manually operable, and a shell 13 sleeved on and movable relative to the outer tubular body 12 to conceal the push button 14. A spring-biased retaining lever 15 is pivotally mounted in the inner tubular body 11, and has a second anchored portion 151 biased by a spring 16 to extend radially and inwardly, and an actuated portion 152 actuated by the button portion 142.

The closing biasing member 76 is disposed between the handle 10 and the upper hub 30 to bias the upper and middle tubes 23,22 to a retracted position where the upper and middle tubes 23,22 are closer to the lower end 25.

The tension retaining member 61 includes an outer surrounding wall 611 which is disposed in the receiving space 111 to be movable along the axis (L), and which is provided with a first anchoring portion 614 extending radially to anchor on the first anchored portion 112, an inner portion 612 which is disposed in the outer surrounding wall 611, and an upwardly biasing member 613 which is disposed between the outer surrounding wall 611 and the inner tubular body 11 to bias the outer surrounding wall 611 to move upwardly when the first anchoring portion 614 is released from the first anchored portion 112.

Figure 3:
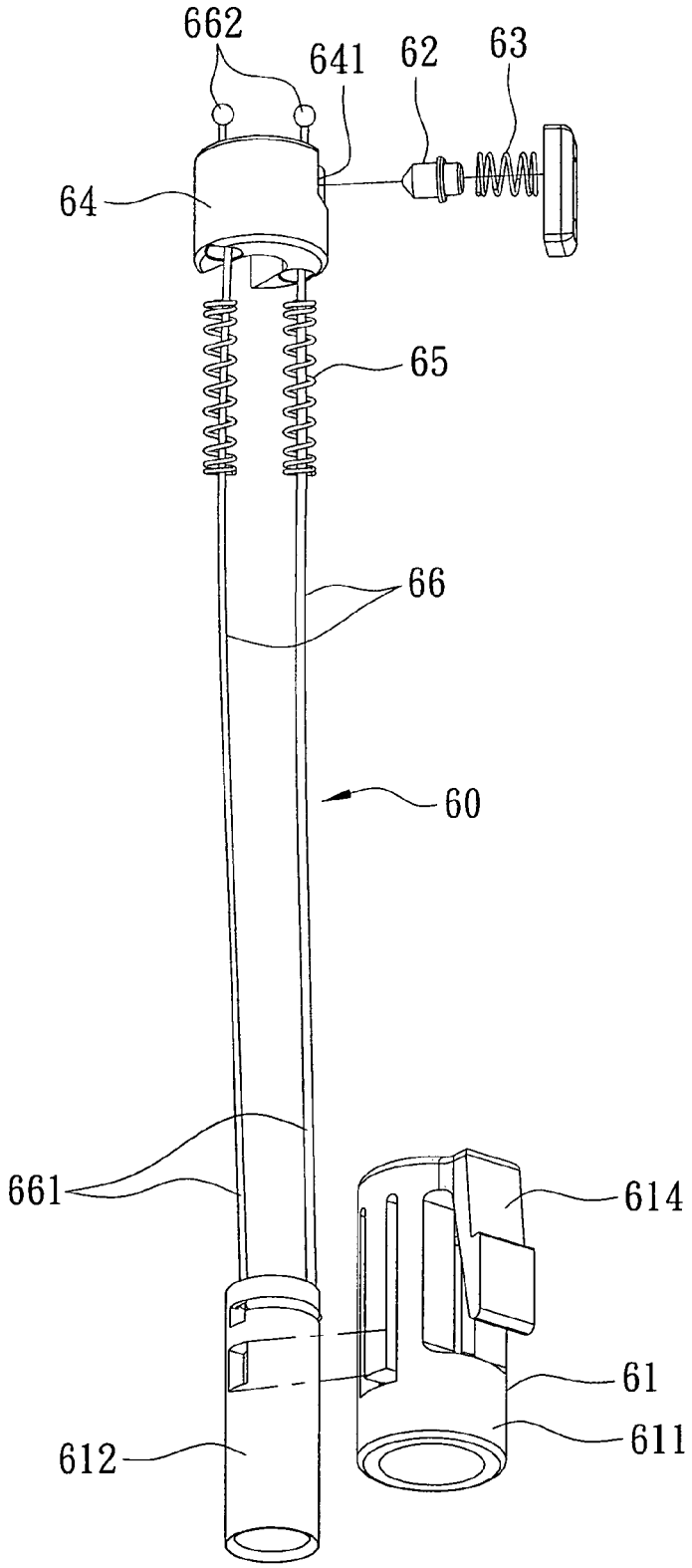
FIG. 3 is an exploded perspective view of a first pull unit of the preferred embodiment.
Figure 4:
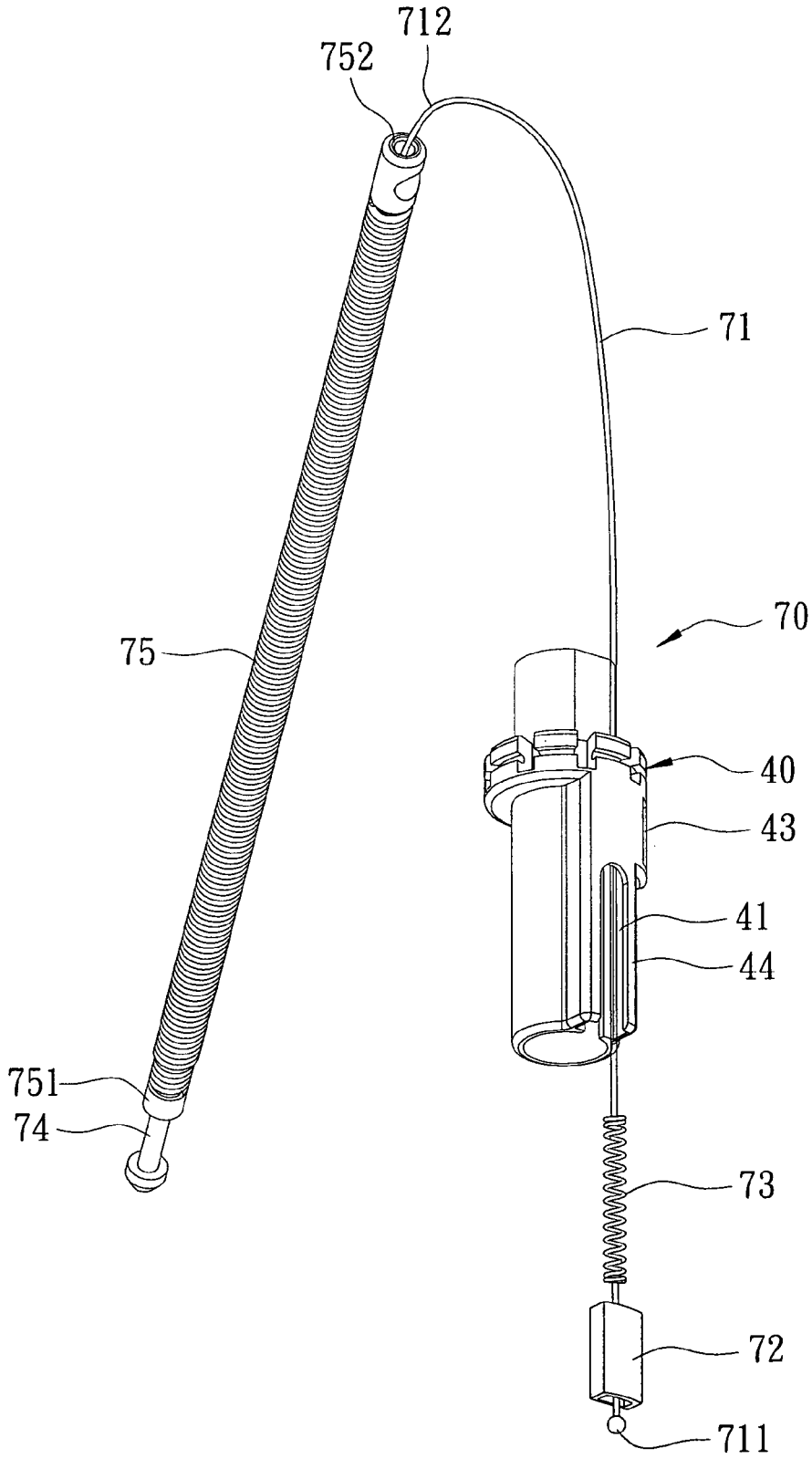
FIG. 4 is a perspective view of a second pull unit and a runner of the preferred embodiment.
Figure 7:
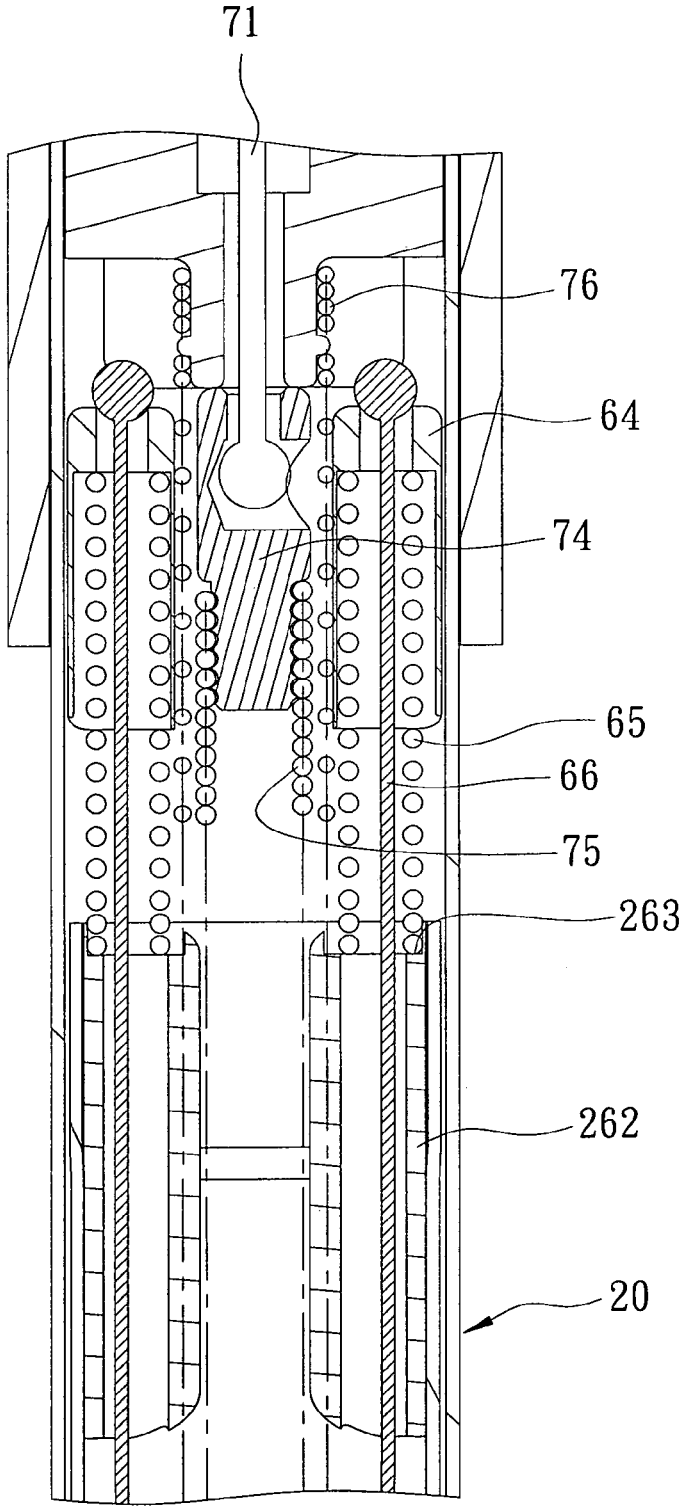
FIG. 7 is an enlarged sectional view of the preferred embodiment.

Referring to FIGS. 2, 3 and 5, the first pull unit 60 includes a first pull cord 66, an actuating member 64, and a first auxiliary biasing member 65. The first pull cord 66 has a first tail end 661 coupled to the inner portion 612, and a first lead end 662 led through the central shaft 20 to be located in the upper tube 23. The actuating member 64 is mounted in the upper tube 23, and is coupled to the first lead end 662 such that, when the upper tube 23 is displaced from the retracted position to the extended position, the actuating member 64 is displaced to a proximate position where the first pull cord 66 is in a tensed state. Referring to FIG. 10, the actuating member 64 has a cam surface 642 confronting the retaining end 621. As shown in FIG. 7, the first auxiliary biasing member 65 is disposed between the actuating member 64 and an upwardly-facing abutment surface 263 of the seat mount 262.

Referring to FIGS. 2, 4, 8 and 9, the second pull unit 70 includes a retained member 74, a tension spring body 75, a second pull cord 71, a trigger member 72, and a second auxiliary biasing member 73. The retained member 74 is mounted in the handle 10 to releasably anchor the second anchored portion 151 of the retaining lever 15. The tension spring body 75 has a second tail end 751 coupled to the retained member 74, and is elongated axially in the central shaft 20 to terminate at a linking end 752. The second pull cord 71 has a second lead end 711 located in the guide track member 44, and extends upwardly to be wound on the direction reversing member 31 to terminate at a linked end 712 that is coupled with the linking end 752. The trigger member 72 is coupled to the second lead end 711 and is movable along the guide route 41. The second auxiliary biasing member 73 is disposed between an upper wall of the guide track member 44 and the trigger member 72.

FIGS. 5 to 7 illustrate the umbrella in a closed and folded state. In this state, the central shaft 20 is in the retracted position, the runner 40 is in the lower position, and the shell 13 is disposed to conceal the push button 14. In addition, the tension spring body 75 and the closing biasing member 76 are in a retracted position.

Figure 8:
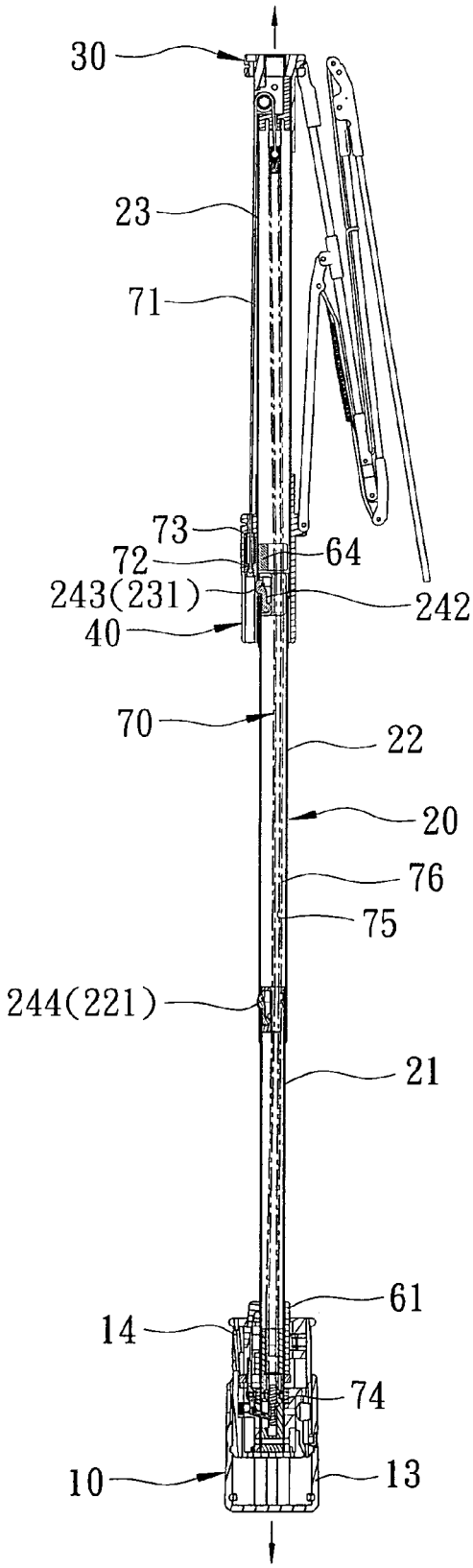
FIG. 8 is a sectional view of the preferred embodiment in an extended state.
Figure 9:
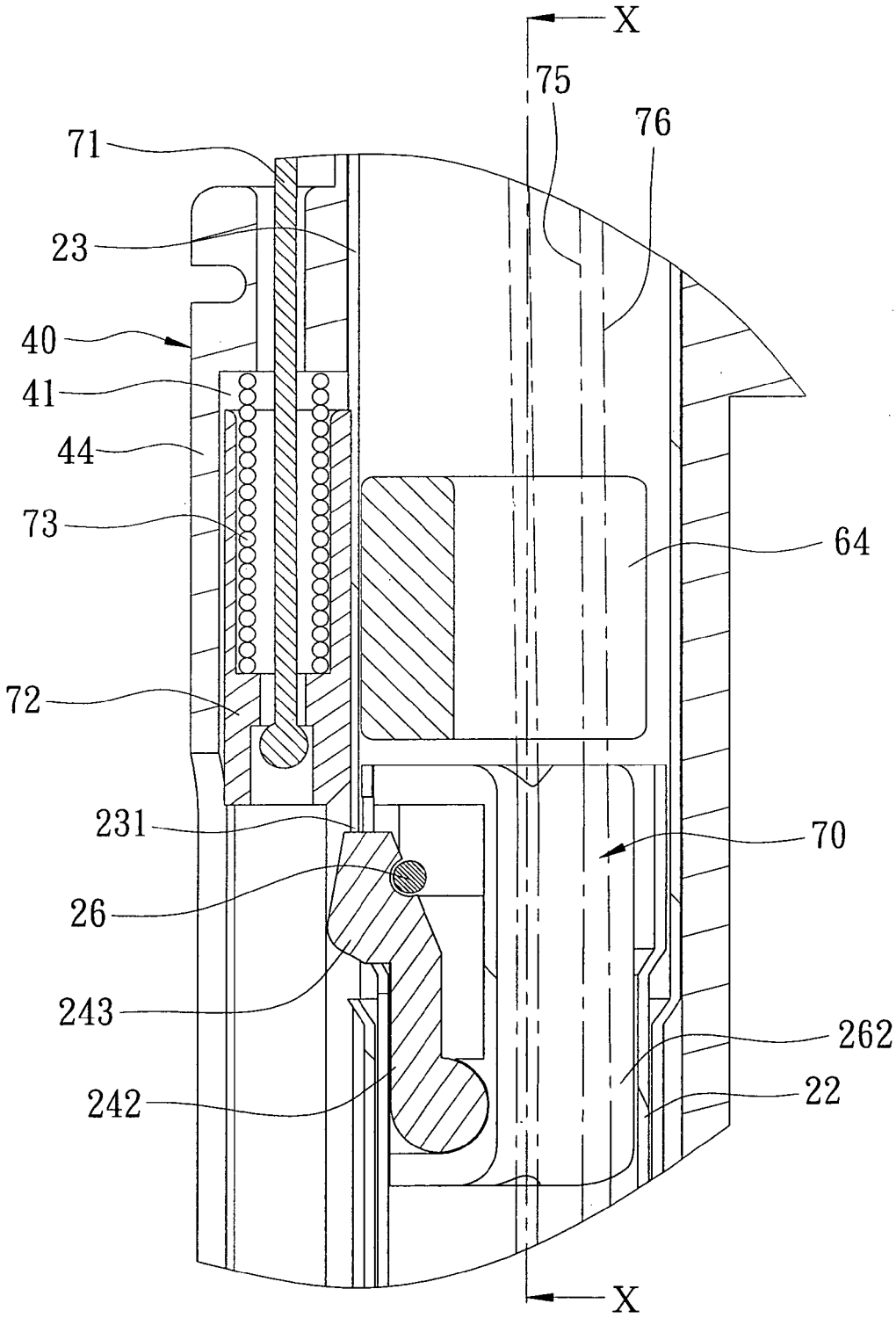
FIG. 9 is an enlarged sectional view of the preferred embodiment in a state of FIG. 8.

Referring to FIGS. 8 to 10, when it is desired to open the umbrella, the user may grip the handle 10 and the upper hub 30 to pull apart such that the upper and middle tubes 23, 22 are displaced to the extended position, and the shell 13 is moved to expose the push button 14. The tension spring body 75 and the closing biasing member 76 are in a stretched position. By virtue of engagement between the shaft-retaining ends 243, 244 and the hooked slits 231,221, the central shaft 20 can be kept in the extended position. The first pull cord 66 is in the tensed state such that the first auxiliary biasing member 65 is compressed by the actuating member 64 to have a first bias force. The retaining end 621 extends into the upper tube 23 through the through hole 232 to retain the runner 40 to the central shaft 20. While the second pull cord 71 is tensed by a counteraction between the trigger member 72 and an urging force generated as a result of stretching of the tension spring body 75, the trigger member 72 is moved upwardly to a ready position where the trigger member 72 is disposed axially and upwardly from the spring-biased shaft-retaining member 242. Meanwhile, the second auxiliary biasing member 73 is compressed by the trigger member 72 to have a second bias force.

Figure 11:
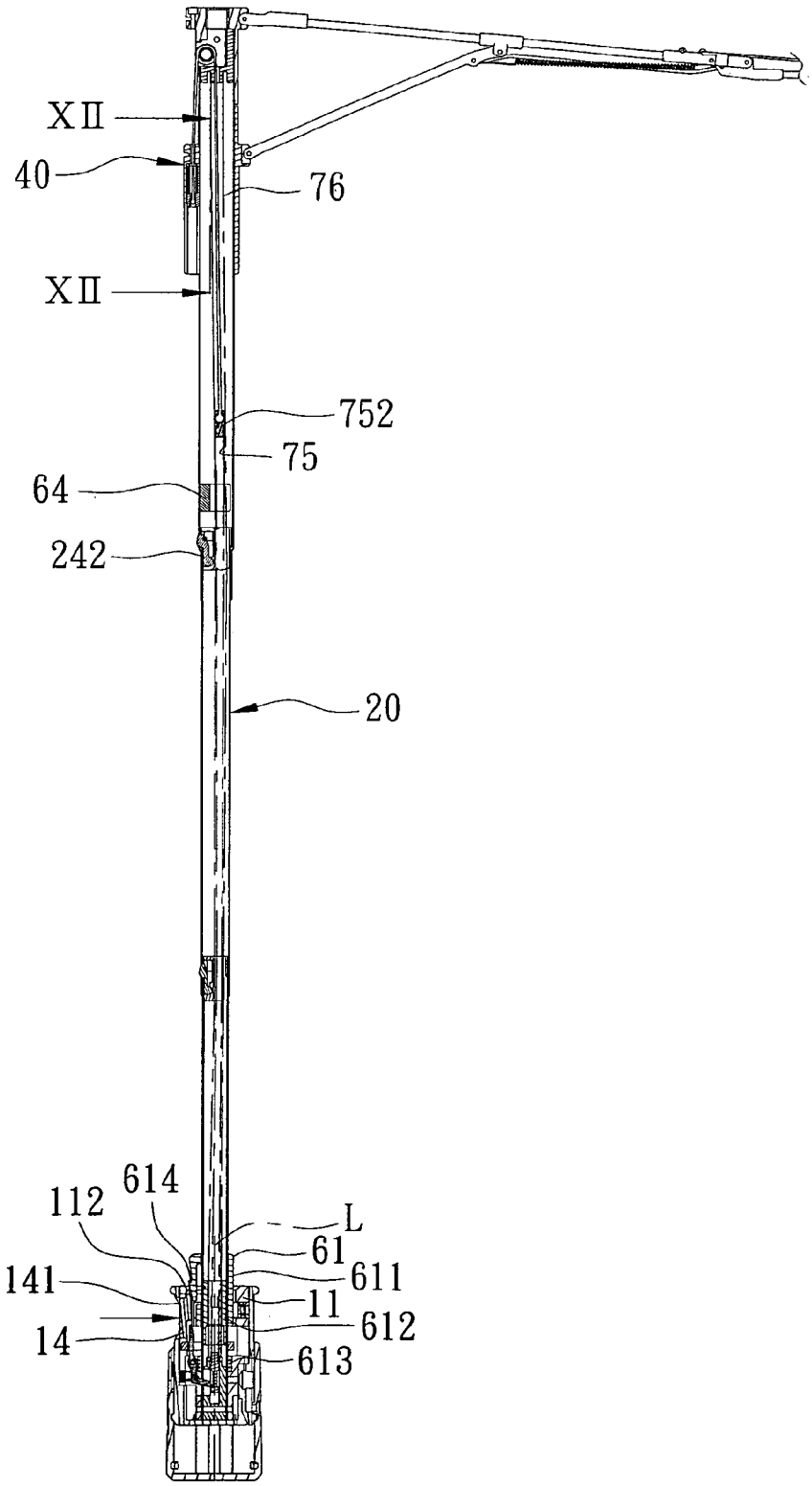
FIG. 11 is a sectional view of the preferred embodiment in an opened state.
Figure 12:
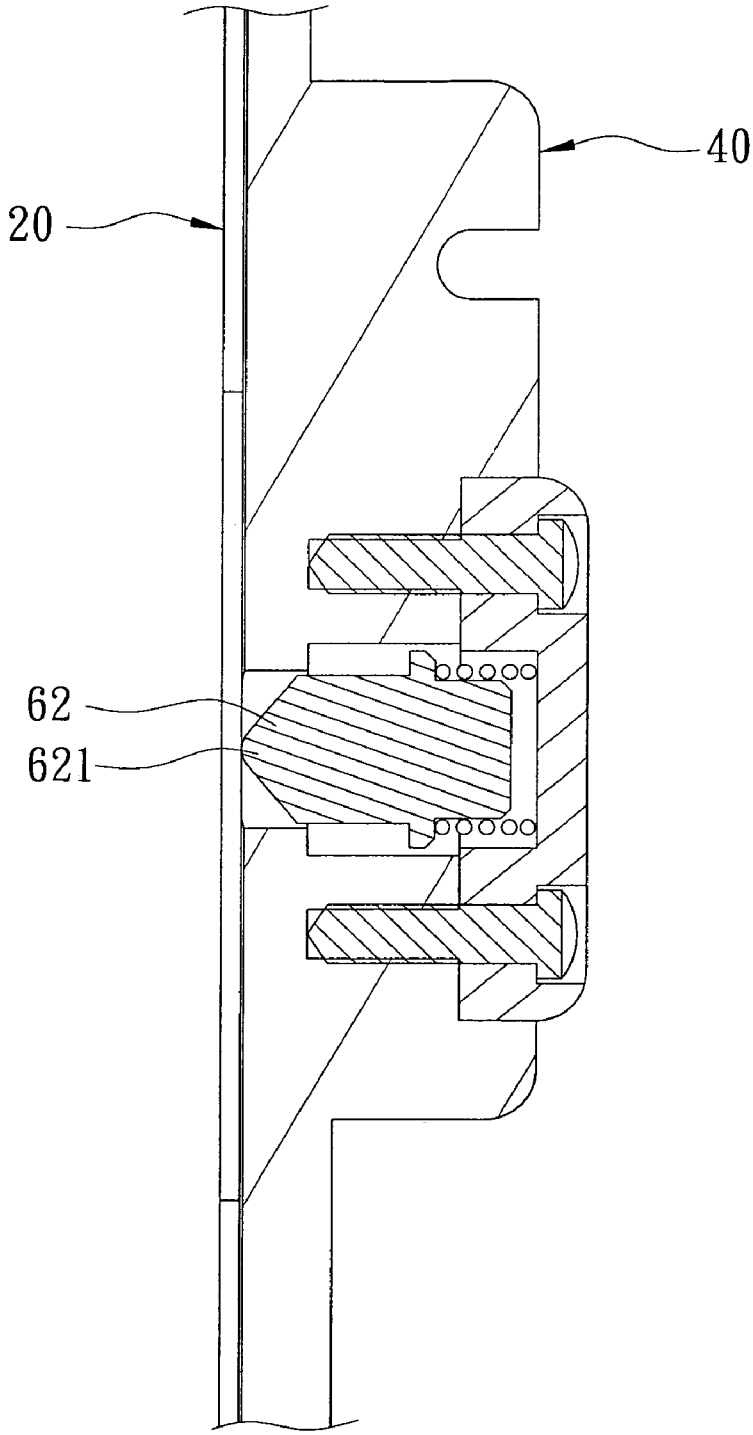
FIG. 12 is a sectional view taken along line XII-XII of FIG. 11.
Figure 13:
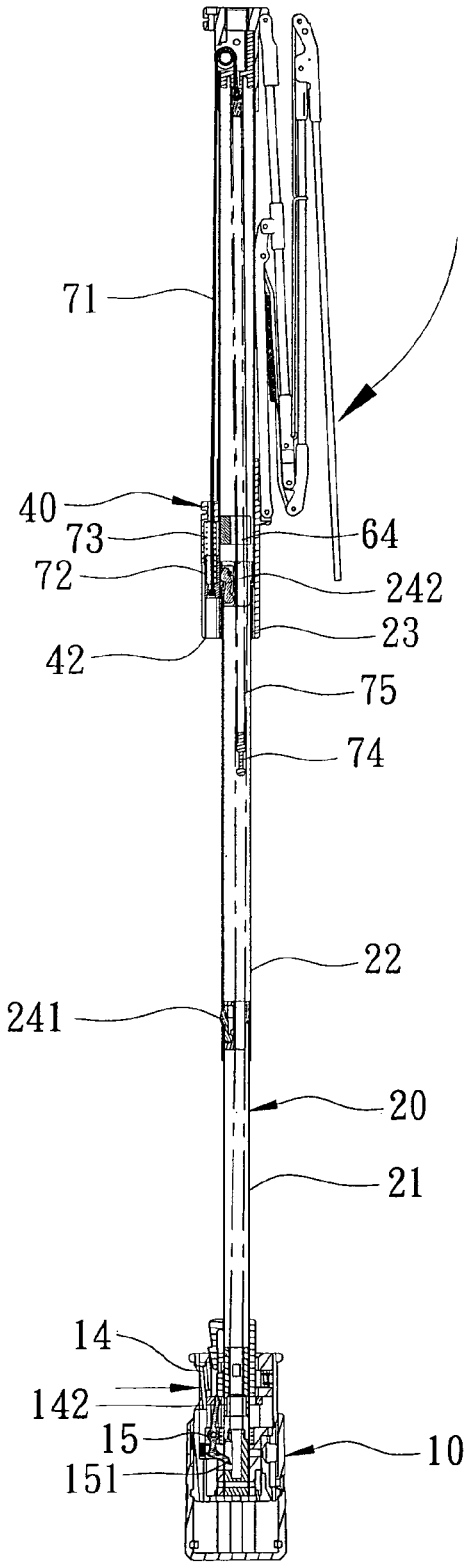
FIG. 13 is a sectional view of the preferred embodiment in a collapsed state.
Figure 14:
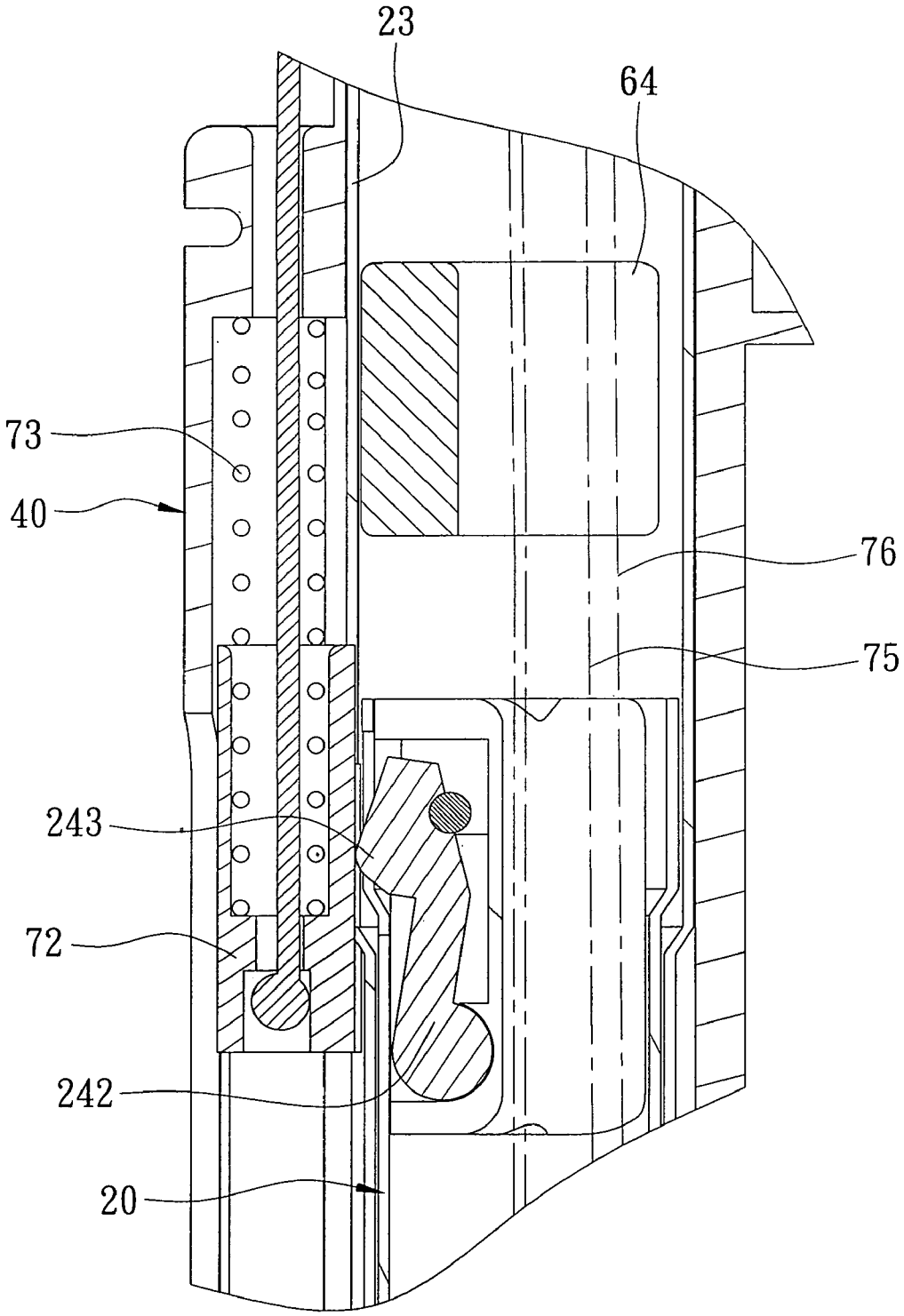
FIG. 14 is an enlarged sectional view of the preferred embodiment in a state of FIG. 13.

Subsequently, referring to FIGS. 11 and 12, the button portion 141 is pushed to release the first anchoring portion 614 from the first anchored portion 112. The tension retaining member 61 is moved upwardly by the upwardly biasing member 613. With reference to FIGS. 3 and 10, by virtue of connection of the first pull cord 66 and the first bias force of the first auxiliary biasing member 65, the actuating member 64 is moved upwardly to a distal position. By provision of the cam surface 642, the upward movement of the actuating member 64 can thrust the retaining end 621 to retreat radially and outwardly of the through hole 232 so as to release the runner 40 from the central shaft 20. Thus, by the urging force of the linking end 752 of the stretched tension spring body 75, the runner 40 is urged to move from the lower position to the upper position so as to spread the umbrella.

When it is desired to close the umbrella, the bottom portion 142 is pushed to release the retained member 74 from the second anchored portion 151 so as to release the urging force. The retained member 74 is moved upwardly, and the second pull cord 71 is in a loosened state so as to collapse the umbrella. Meanwhile, the runner 40 is moved downwardly, and the trigger member 72 is then biased by the second bias force of the second auxiliary biasing member 73 to dash downward and away from the ready position so as to thrust the shaft-retaining end 243 of the shaft-retaining member 242 to disengage from the upper tube 23. Thus, the upper tube 23 is moved by the closing biasing member 76 toward the handle 10 to the retracted position by sliding over the middle tube 22 and continuing on pressing the shaft-retaining member 241 inwardly of the lower tube 21. As a result, the middle tube 22 and the upper tube 23 are sequentially moved by sliding over the lower tube 21.

Figure 15:
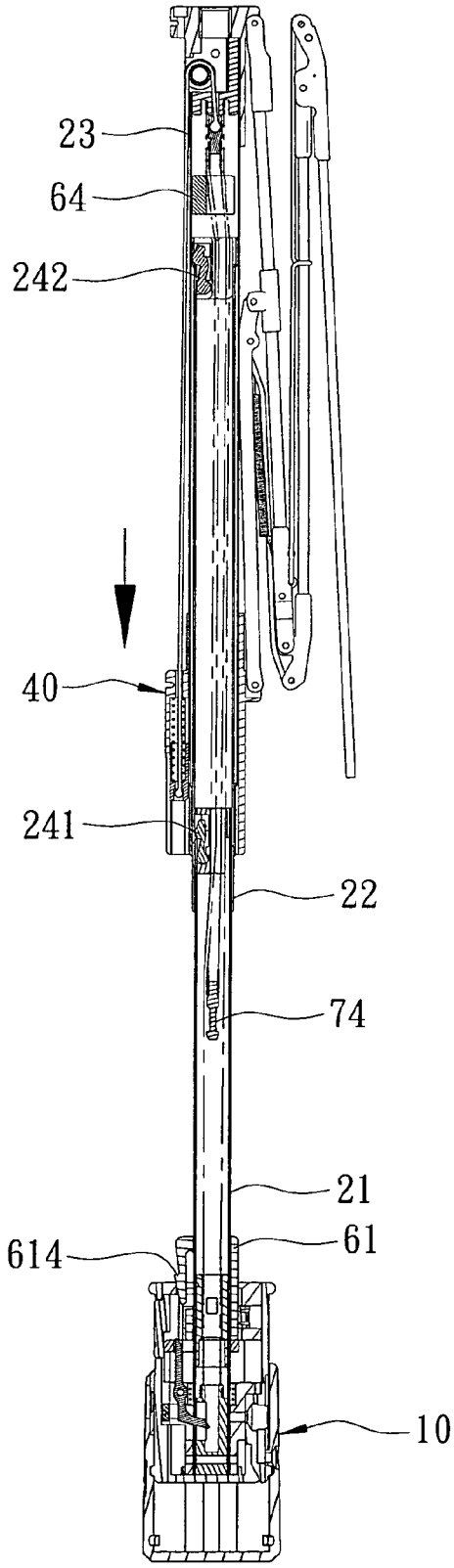
FIG. 15 is a sectional view of the preferred embodiment when a central shaft displaced from an extended position to a retracted position.
Figure 16:
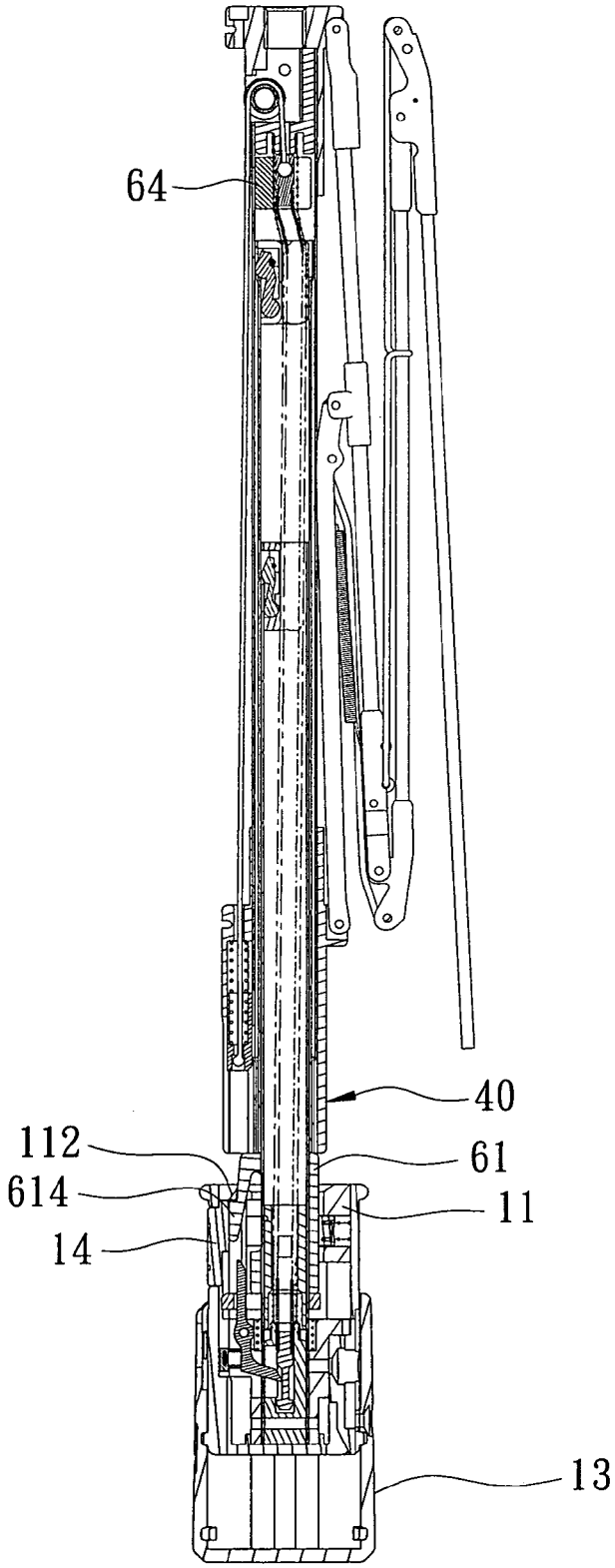
FIG. 16 is a sectional view of the preferred embodiment in a fully folded state.

Referring to FIGS. 15 and 16, the downward movement of the upper and middle tubes 23,22 can press the tension retaining member 61 into the inner tubular body 11 to permit the first anchoring portion 614 to be retained at the first anchored portion 112. Finally, the shell 13 is manually moved to conceal the push button 14.

As illustrated, by virtue of the tension spring body 75 and the first auxiliary biasing member 65, the runner 40 can be automatically moved to the upper position to spread the umbrella by operation of the push button 14. By virtue of the tension spring body 75 and the trigger member 72 aided by the second auxiliary biasing member 73, the shaft-retaining member 242 can be easily and successfully disengaged from the upper tube 23 to permit the upper and middle tubes 23,22 to slide over the lower tube 21 when the push button 14 is operated during closing of the umbrella. Accordingly, operations of opening and closing of the umbrella are convenient and effortless.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A semi-automatic umbrella comprising:

a central shaft including at least an upper tube and a middle tube which is telescopically fitted to said upper tube along an axis, said central shaft having upper and lower ends opposite to each other along the axis;

a direction reversing member disposed in said upper end of said central shaft;

a spring-biased shaft-retaining member disposed on said middle tube and engageable with said upper tube so as to hold said upper tube in an extended position where said upper tube is remote from said lower end;

a runner disposed around said central shaft and slidable therealong between upper and lower positions to spread and collapse the umbrella, respectively;

a spring-biased runner-retaining member disposed in said runner, and biased to be engaged with said upper tube;

a closing biasing member disposed to bias said upper tube to a retracted position where said upper tube is closer to said lower end;

a handle secured to said lower end of said central shaft, and having first and second anchored portions;

a tension retaining member mounted in said handle and having a first anchoring portion disposed to anchor said first anchored portion, said tension retaining member being operable manually to disengage said first anchoring portion from said first anchored portion to release said tension retaining member, thereby permitting axial movement thereof relative to said handle;

a first pull cord having a first tail end coupled to said tension retaining member, and a first lead end which is led through said central shaft to be located in said upper tube;

an actuating member which is mounted in said upper tube, and which is coupled to said first lead end such that, when said upper tube is displaced from the retracted position to the extended position, said actuating member is displaced to a proximate position, where said first pull cord is in a tensed state;

a first auxiliary biasing member disposed between said actuating member and said middle tube with such a first bias force that, once said tension retaining member is released, an upward biased movement of said actuating member to a distal position thrusts said spring-biased runner-retaining member to be disengaged from said upper tube so as to permit movement of said runner toward the upper position;

a retained member mounted in said handle to releasably anchor said second anchored portion;

a tension spring body which has a second tail end coupled to said retained member, and which is elongated axially in said central shaft to terminate at a linking end, said tension spring body being stretched when said upper tube is moved to the extended position, thereby vesting said linking end with an urging force, the urging force being releasable by virtue of releasing of said retained member from said second anchored portion;

a second pull cord which has a second lead end located in said runner, and which extends upwardly to be wound on said direction reversing member to terminate at a linked end that is coupled with said linking end so as to permit the urging force to pull said second lead end for moving said runner from the lower position to the upper position when said tension retaining member is released;

a trigger member coupled to said second lead end and moved with said runner so as to counteract the urging force, said trigger member being disposed to be movable to a ready position where said trigger member is disposed axially and upwardly from said spring-biased shaft-retaining member as a result of manual displacement of said upper tube from the retracted position to the extended position; and a second auxiliary biasing member disposed to have a second bias force such that, immediately after the urging force is released to permit said runner and said trigger member to move to the lower position, said trigger member is biased by the second bias force to dash downward and away from the ready position so as to thrust said spring-biased shaft-retaining member to disengage from said upper tube, thereby permitting a displacement of said upper tube from the extended position to the retracted position by said closing biasing member.

2. The semi-automatic umbrella according to claim 1, wherein said upper tube has a bottom segment having a hooked slit, said middle tube having a top segment and a seat mount disposed in said top segment, said spring-biased shaft-retaining member being mounted on said seat mount and having a shaft-retaining end which is biased radially and outwardly of said middle tube to be snapped into said hooked slit when said upper tube is displaced to the extended position.

3. The semi-automatic umbrella according to claim 2, wherein said seat mount has an abutment surface facing upwardly, said first auxiliary biasing member being disposed between said actuating member and said abutment surface.

4. The semi-automatic umbrella according to claim 2, wherein said spring-biased runner-retaining member has a retaining end, said bottom segment of said upper tube having a through hole which extends radially to permit said retaining end to extend into said upper tube, said actuating member having a cam surface which is configured such that, when said actuating member is displaced from the proximate position to the distal position, said retaining end is thrust to retreat radially and outwardly of said through hole.

5. The semi-automatic umbrella according to claim 1, wherein said runner has a guide track member which defines a guide route extending axially to guide said trigger member to move toward the ready position.

6. The semi-automatic umbrella according to claim 1, wherein said handle includes an inner tubular body defining a receiving space and formed with said first anchored portion in said receiving space, an outer tubular body surrounding said inner tubular body and having a button opening, a push button disposed in said button opening and having two button portions to be manually operable to respectively release said first anchoring portion from said first anchored portion, and said second anchored portion from said retained member, and a shell sleeved on and movable relative to said outer tubular body to conceal said push button.

7. The semi-automatic umbrella according to claim 6, wherein said tension retaining member includes an outer surrounding wall which is disposed in said receiving space to be movable along the axis, and on which said first anchoring portion is disposed and extends radially to anchor on said first anchored portion, an inner portion which is disposed in said outer surrounding wall and which is connected with said first tail end of said first pull cord, and an upwardly biasing member which is disposed between said outer surrounding wall and said inner tubular body to bias said outer surrounding wall to move upwardly when said first anchoring portion is released from said first anchored portion.

* * * * *